US008794238B2

(12) United States Patent
Nguyen et al.

(10) Patent No.: US 8,794,238 B2
(45) Date of Patent: Aug. 5, 2014

(54) SPLASH-FLUID RESISTANT FILTERING FACE-PIECE RESPIRATOR

(75) Inventors: Nhat Ha T. Nguyen, Woodbury, MN (US); John J. Rogers, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 266 days.

(21) Appl. No.: 12/979,868

(22) Filed: Dec. 28, 2010

(65) Prior Publication Data

US 2012/0160246 A1 Jun. 28, 2012

(51) Int. Cl.

| | |
|---|---|
| ***A62B 23/02*** | (2006.01) |
| ***A62B 7/10*** | (2006.01) |
| ***A62B 18/02*** | (2006.01) |

(52) U.S. Cl.

USPC ..... 128/205.29; 128/205.27; 128/206.21

(58) Field of Classification Search

CPC ..... A41D 13/11; A41D 13/1107; A41D 13/1115; A41D 13/1146; A41D 2400/60; A41D 2400/62; A41D 2500/30; A41D 2400/20; A41D 2400/22; A62B 23/00; A62B 23/02; A62B 23/025; A62B 23/06; A62B 7/00; A62B 7/10; A62B 17/00

USPC ..... 55/382, 486–489, 527; 95/134, 154, 95/376, 230; 128/205.27–205.29, 857, 128/863; 428/195.1, 196

See application file for complete search history.

(56) References Cited

U.S. PATENT DOCUMENTS

| | | | | |
|---|---|---|---|---|
| 535,718 | A * | 3/1895 | Nagler | 128/206.12 |
| 3,490,447 | A * | 1/1970 | Jackson | 128/863 |
| 3,603,315 | A * | 9/1971 | Becker, III | 128/206.19 |
| 3,929,125 | A | 12/1975 | Barnes et al. | |
| 4,536,440 | A | 8/1985 | Berg | |
| 4,807,619 | A | 2/1989 | Dyrud et al. | |
| 4,827,924 | A | 5/1989 | Japuntich | |
| 4,850,347 | A | 7/1989 | Skov | |
| 4,920,960 | A | 5/1990 | Hubbard et al. | |
| 4,951,664 | A * | 8/1990 | Niemeyer | 128/206.24 |
| 4,969,457 | A | 11/1990 | Hubbard et al. | |
| 5,307,796 | A | 5/1994 | Kronzer et al. | |
| 5,467,765 | A | 11/1995 | Maturaporn | |
| 5,553,608 | A | 9/1996 | Reese et al. | |

(Continued)

FOREIGN PATENT DOCUMENTS

| | | | |
|---|---|---|---|
| EP | 0965280 | A2 | 12/1999 |
| EP | 1040803 | A1 | 10/2000 |
| WO | WO 85/02351 | | 6/1985 |
| WO | WO 2009/020811 | A2 | 2/2009 |

*Primary Examiner* — Justine Yu
*Assistant Examiner* — Michael Tsai
(74) *Attorney, Agent, or Firm* — Karl G. Hanson

(57) ABSTRACT

A filtering face-piece respirator 10 that comprises a mask body 12 and a harness 14 that is joined to the mask body 12. The mask body 12 includes a filter layer 30 and a nonwoven fibrous cover web 16. The fibrous cover web 16 is partially occluded and is generally parallel to and spaced from the filter layer 30 such that air passing through the cover web 16 can move freely between the cover web 16 and the filter layer 30 so that it can enter the filter layer 30 at essentially any available point over the filter layer surface 32. The inventive respirator is beneficial in that it can provide very good splash fluid and airborne contaminant protection while also exhibiting an extraordinary low pressure drop across the mask body during breathing.

24 Claims, 2 Drawing Sheets

(56) References Cited

U.S. PATENT DOCUMENTS

| | | | | | |
|---|---|---|---|---|---|
| 5,706,804 | A | | 1/1998 | Baumann et al. | |
| 5,813,398 | A | | 9/1998 | Baird et al. | |
| 5,883,026 | A | | 3/1999 | Reader et al. | |
| 6,041,782 | A | | 3/2000 | Angadjivand et al. | |
| D424,688 | S | | 5/2000 | Bryant et al. | |
| 6,123,077 | A | | 9/2000 | Bostock et al. | |
| D431,647 | S | | 10/2000 | Henderson et al. | |
| 6,145,504 | A | * | 11/2000 | Miyake | 128/206.19 |
| D443,927 | S | | 6/2001 | Chen | |
| D448,472 | S | | 9/2001 | Chen | |
| 6,394,090 | B1 | | 5/2002 | Chen et al. | |
| 6,484,722 | B2 | | 11/2002 | Bostock et al. | |
| 6,568,392 | B1 | | 5/2003 | Bostock et al. | |
| 6,923,182 | B2 | | 8/2005 | Angadjivand et al. | |
| 6,942,894 | B2 | | 9/2005 | Alberg et al. | |
| 6,962,635 | B2 | | 11/2005 | Tuman et al. | |
| 7,131,442 | B1 | | 11/2006 | Kronzer et al. | |
| 7,662,462 | B2 | | 2/2010 | Noda et al. | |
| 7,725,948 | B2 | | 6/2010 | Steindorf | |
| 2005/0133036 | A1 | | 6/2005 | Steindorf | |
| 2005/0183727 | A1 | * | 8/2005 | Chou | 128/206.19 |
| 2006/0266364 | A1 | | 11/2006 | Turdjian | |
| 2009/0078265 | A1 | * | 3/2009 | Gebrewold et al. | 128/206.19 |

* cited by examiner

SPLASH-FLUID RESISTANT FILTERING FACE-PIECE RESPIRATOR

The present invention pertains to a filtering face-piece respirator that has a partially occluded cover web disposed in a spatial relationship to an underlying filter layer.

BACKGROUND

Filtering face-piece respirators are distinguishable from other respiratory masks in that the mask body itself functions as the filtering mechanism. Unlike respirators that use rubber or elastomeric mask bodies in conjunction with attachable filter cartridges (see, e.g., U.S. Pat. No. RE39,493 to Yuschak et al.) or insert-molded filter elements (see, e.g., U.S. Pat. No. 4,790,306 to Braun), filtering face-piece respirators are fashioned to have the filter media comprise much of the whole mask body surface so that there is no need for installing or replacing a filter cartridge. As such, filtering face-piece respirators are relatively light in weight, easy to use, and are disposable. Examples of filtering face-piece respirators are shown in the following U.S. Pat. No. 7,131,442 to Kronzer et al, U.S. Pat. Nos. 6,923,182 and 6,041,782 to Angadjivand et al., U.S. Pat. Nos. 6,568,392 and 6,484,722 to Bostock et al., U.S. Pat. No. 6,394,090 to Chen, U.S. Pat. No. 4,807,619 to Dyrud et al., U.S. Pat. No. 4,536,440 to Berg, and in U.S. Patent Application Publication 2009/0078265A1 to Martin et al.

Workers regularly wear filtering face-piece respirators to protect themselves from inhaling airborne contaminants or to protect other persons or things from being exposed to pathogens and other contaminants exhaled by the wearer. Doctors, for example, commonly wear a respirator in an operating room to protect the patient from infection. In addition to removing airborne contaminants from inhale and exhale airstreams, filtering face-piece respirators also are worn to protect the wearer from splash fluids. An emergency room worker, for instance, can be exposed to blood ejected from a severed artery. Thus, some filtering face-piece respirators must properly satisfy the dual function of filtering air and stopping splash fluids. These dual functions, however, can be at odds with each other. Stopping fast moving liquid streams generally requires a fluid impermeable surface, whereas, air filtration demands fluid permeability at a low pressure drop.

"Pressure drop" is a term that refers to a difference in air pressure on both sides of the filter media or mask body. Lower pressure drops are desired in filtering face piece respirators so that the wearer need not work as hard to bring air or oxygen into their system. Since it is the wearer's lungs that pull the ambient air through the filtering face-piece, when there is less pressure drop, the wearer does not need to work as hard to breathe clean air. Low pressure drops are particularly desired by workers who wear filtering face piece respirators over extended time periods.

Because the dual function of stopping splash fluids and removing contaminants from ambient air are generally at odds with each other, investigators are presented with dilemma in fashioning a product that can deliver both splash fluid protection and air filtration without sacrificing pressure drop.

SUMMARY OF THE INVENTION

The present invention provides a filtering face-piece respirator that comprises a mask body and a harness that is joined to the mask body. The mask body includes a filter layer and a nonwoven fibrous cover web. The fibrous web is partially occluded and is generally parallel to and spaced from the filter layer such that air passing through the cover web can move freely between the cover web and the filter layer so that it can enter the filter layer at essentially any available point over the filter layer surface.

The present invention is beneficial in that it can provide very good splash fluid protection while also exhibiting an extraordinary low pressure drop across the mask body during breathing. The inventive mask body structure can stop splash fluids while also allowing the ambient air to pass through the mask body essentially unimpeded—that is, as if the splash fluid barrier was not present. The improved result is achieved by spacing the cover web with its occluded surface from the filter layer so that a plenum-type effect is achieved between the two layers whereby the inhaled air freely moves between the cover web and the filter layer so that it can enter the filter layer at essentially any available point over the filter layer surface.

GLOSSARY

The terms set forth below will have the following meanings:

"comprises (or comprising)" means its definition as is standard in patent terminology, being an open-ended term that is generally synonymous with "includes", "having", or "containing" Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive subject matter;

"clean air" means a volume of atmospheric ambient air that has been filtered to reduce contaminants;

"contaminants" means particles (including dusts, mists, and fumes) and/or other substances that generally may not be considered to be particles (e.g., organic vapors, et cetera) but which may be suspended in air, including air in an exhale flow stream;

"cover web" means a nonwoven fibrous structure that resides on one side of a filter layer;

"exhalation valve" means a valve that has been designed for use on a respirator to open unidirectionally in response to pressure or force from exhaled air;

"exhaled air" means air that is exhaled by a respirator wearer;

"exterior gas space" means the ambient atmospheric gas space into which exhaled gas enters after passing through and beyond the mask body and/or exhalation valve;

"exterior surface" means that the surface that is located on the exterior;

"filtering face-piece" means that the mask body itself is designed to filter air that passes through it; there are no separately identifiable filter cartridges or inserted molded filter elements attached to or molded into the mask body to achieve this purpose;

"filter" or "filtration layer" means one or more layers of air-permeable material, which layer(s) is adapted for the primary purpose of reducing contaminants (such as particles) from an air stream that passes through it;

"filter media" means an air-permeable structure that is designed to remove contaminants from air that passes through it;

"filtering structure" means a construction that is designed primarily for filtering air;

"harness" means a structure or combination of parts that assists in supporting the mask body on a wearer's face;

"interior gas space" means the space between a mask body and a person's face;

"mask body" means an air-permeable structure that is designed to fit over the nose and mouth of a person and that helps define an interior gas space separated from an exterior gas space;

"occluded" means to prevent the passage of a fluid therethrough;

"parallel" means being equal distance apart;

"partially" means not completely;

"particles" means any liquid and/or solid substance that is capable of being suspended in air, for example, dusts, mists, fumes, pathogens, bacteria, viruses, mucous, saliva, blood, etc.;

"perimeter" means the outer peripheral portion of the mask body, which outer portion would be disposed generally proximate to a wearer's face when the respirator is being donned by a person;

"polymeric" and "plastic" each mean a material that mainly includes one or more polymers and may contain other ingredients as well;

"plurality" means two or more;

"respirator" means an air filtration device that is worn by a person to provide the wearer with clean air to breathe;

"spaced" means physically separated or having measurable distance therebetween;

"support structure" means a construction that is designed to have sufficient structural integrity to retain the mask in an intended three-dimensional shape and that helps retain the intended shape of the filtering structure supported by it, under normal handling;

DETAILED DESCRIPTION OF PREFERRED EMBODIMENTS

In the practicing the present invention, a new filtering face mask is provided that may improve splash resistance while also providing very good air filtration without sacrificing pressure drop across the mask body. The present invention thus may improve worker safety and provide safety benefits to workers and others who wear personal respiratory protection devices.

Figure 1:
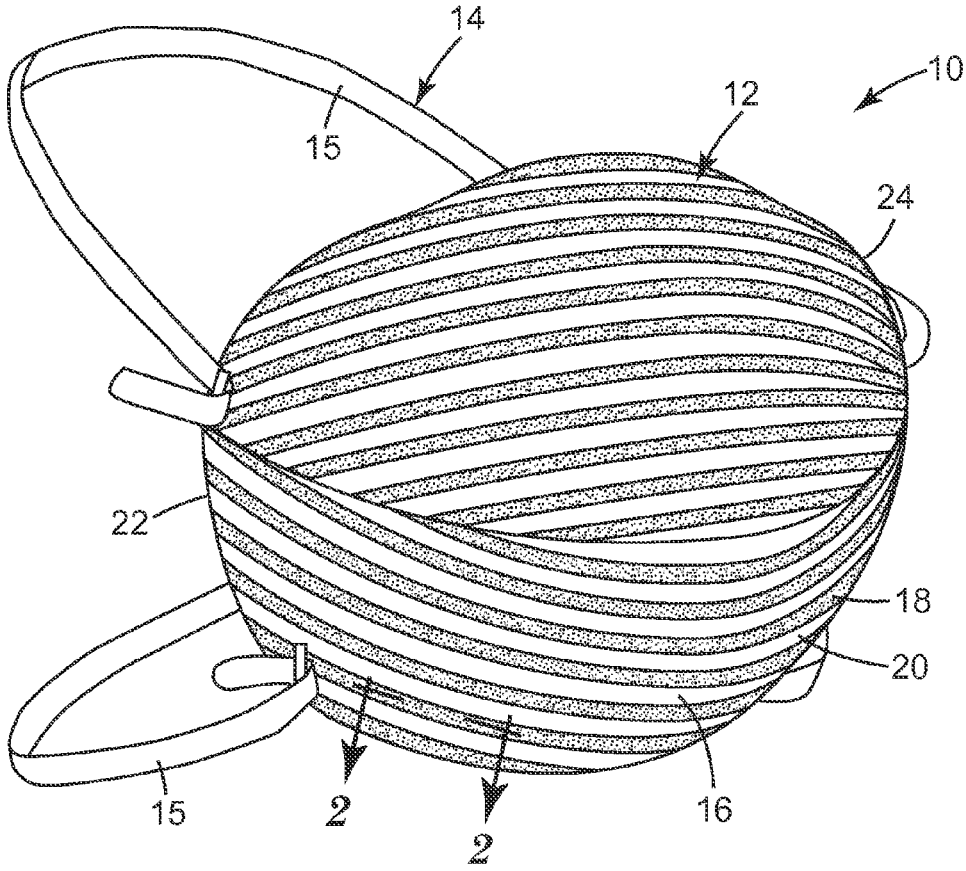
FIG. 1 is a perspective view of a filtering face-piece respirator 10 in accordance with the present invention.

FIG. 1 illustrates an example of a filtering face mask 10 that may be used in conjunction with the present invention. Filtering face mask 10 is a half mask (because it covers the nose and mouth but not the eyes) that has a cup-shaped mask body 12. Mask body 12 is adapted to fit over the nose and mouth of a person in spaced relation to the wearer's face to create an interior gas space or void between the wearer's face and the interior surface of the mask body. The illustrated mask body 12 is fluid permeable and may be provided with an opening for securement of an exhalation valve to the mask body. Exhalation valves are commonly used to allow exhaled air to exit the interior gas space through the valve without having to pass through the mask body itself. The preferred location of the opening on the mask body is directly in front of where the wearer's mouth would be when the mask is being worn. For a mask body 12 of the type shown in FIG. 1, essentially the entire exposed surface of mask body 12 is fluid permeable to inhaled air. To hold the face mask snugly upon the wearer's face, mask body can have a harness 14 that includes one of more straps 15, tie strings, or any other suitable means attached to it for supporting the mask body 12 on the wearer's face. The mask body has an outer cover web 16 that includes occluded and non-occluded areas 18 and 20, respectively. The occluded areas 18 comprise a fluid impermeable material such as plastic, and in the present embodiment are illustrated as stripes that extend from a first side 22 of the mask body 12 to a second side 24. The occluded areas 18 also may comprise other shapes such as spots, ovals, rectangles, triangles, etc. Typically, each contiguous occluded area is spaced not more than 1.75 millimeters (mm), more typically not more than 1.5 mm, from an adjacent non-occluded area. The occluded areas typically are present on the mask body at a surface area ratio of maximum of about 4.4:1.4 and a minimum of about 2.6:3.8, to the non-occluded areas of the mask body. Total mask body thickness is typically about 2 to 6 mm, more typically 3 to 5 mm. The mask body may be spaced from the wearer's face, or it may reside flush or in close proximity to it. In either instance, the mask helps define an interior gas space into which exhaled air passes before leaving the mask interior through the exhalation valve. The mask body also could have a thermochromic fit-indicating seal at its periphery to allow the wearer to easily ascertain if a proper fit has been established—see U.S. Pat. No. 5,617,849 to Springett et al.

Figure 2:
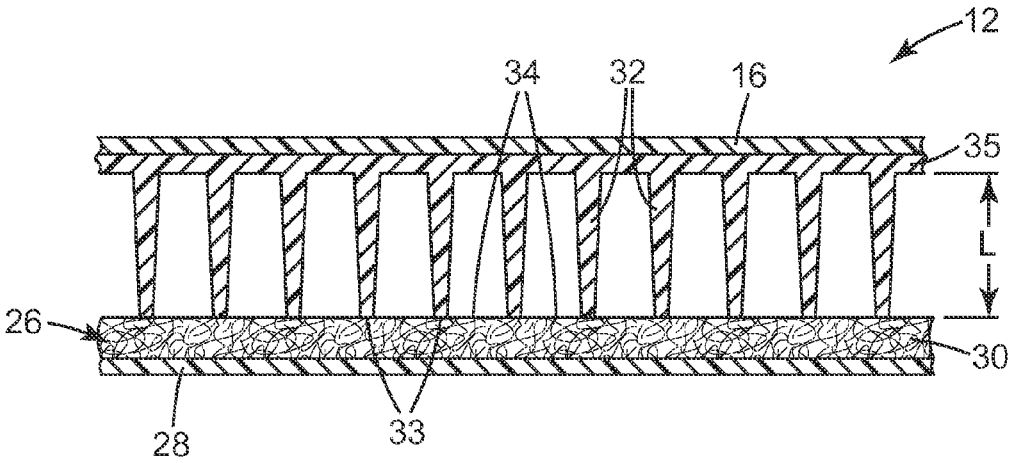
FIG. 2. is an enlarged cross-sectional view taken through the mask body 12 along lines 2-2 of FIG. 1.

FIG. 2 shows that the mask body 12 includes a filtering structure 26 that comprises multiple layers such as a shaping layer 28 and a filter layer 30. The shaping layer 28 provides structure to the mask body 12 and support for the filter layer 30. The shaping layer 28 may be located on the inside and/or outside of filtration layer 30 (or on both sides) and can be made, for example, from a nonwoven web of thermally-bondable fibers, molded into a cup-shaped configuration—see U.S. Pat. No. 4,807,619 to Dyrud et al. and U.S. Pat. No. 4,536,440 to Berg. It also can be made from a porous layer or an open work "fishnet" type network of flexible plastic, like the shaping layer disclosed in U.S. Pat. No. 4,850,347 to Skov. The shaping layer can be molded in accordance with known procedures such as those described in U.S. Pat. No. 5,307,796 to Kronzer et al. Although the shaping layer 28 is designed with the primary purpose of providing structure to the mask and providing support for a filtration layer, shaping layer 28 also may act as a filter, typically for capturing larger particles. On the outer layer of the filtering structure 26 is the cover web 16 that includes the occluded and non-occluded areas 18 and 20, respectively. Spacer elements 32 are provided, which separate the filter layer 30 from the cover web 16. The spacer elements 32 may be integral extensions of the occluded areas 18. Typically, the spacer elements have a length L of about 0.5 to 3 mm, more typically 1 to 2.5 mm. The spacer elements may be in the form of small columns having a cross-sectional area of about 0.1 to 1 square mm, more typically 0.15 to 0.25 $mm^2$. Along the length of an occluded area, there typically are about 5 to 30 spacer elements per centimeter (cm). The spacer elements meet the filter layer 30 at ends 33. The ends 33 may be bonded or entangled to the filter layer 30. Deposits of polymer may be used to create the spacing elements. This step can be accomplished by depositing the polymer onto the outer cover web 16. The spacer elements 32 create a reservoir space that reduces kinetic energies of impacting liquids (eg: blood) on the mask body 12. The spacer elements 32 further enable or facilitate airflow between the layers to help distribute the air across the filter layer surface 34. Polymeric spacers can be created using a profile extrusion die or a strand die having adequate height to the strands, polymer printing techniques as described in U.S. Pat. No. 6,942,894, and screen printing options or other known methods. The polymer spacer elements can be enhanced by micro-replication to create substructures such as pins, posts, stems and other protuberances that allow air to flow across the arranged spacer elements. The spacer elements can be made continuously down web or cross-web or as discontinuous parts when providing the outer cover web 16. The mask body 12 also may include an inner cover web (not shown) that can protect the filter layer 30 from abrasive forces and that can retain any fibers that may come loose from the filter layer 30 and/or shaping layer 28. A mask body that uses the partially occluded areas on the outer cover web in accordance with the present invention may exhibit a pressure drop across the mask body which is the same or better the pressure drop across the same mask body without the occluded areas. The pressure drop may be 10% less than the pressure drop across the same mask body without the occluded areas.

Figure 3:
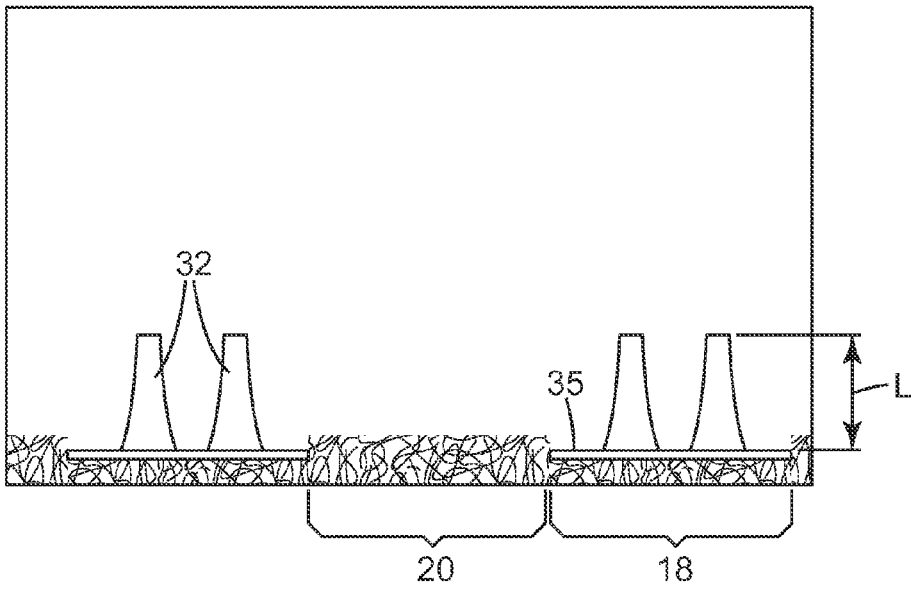
FIG. 3. is a photographic cross-section of occluded 20 and non-occluded 18 areas of a mask body.

FIG. 3 shows an enlarged photographic cross-section of occluded and non-occluded areas taken through a mask body of the present invention. During respirator use, air passes through the non-occluded zone 20 to enter the interior gas space of the respirator mask body. The occluded areas 18 may include two or more spacer elements (e.g. 2, 3, 4, or 5) extending across the width of an elongated occluded area 18. The elongated occluded area 18 may be in the form of a stripe that extends across the mask body from a first side to a second side. Thus, a series of stripes may extend across the mask body to give it a striped appearance as shown in FIG. 2. The height or length L of the spacer element is shown as the distance from which the element 32 projects perpendicularly from the base 35 of the occluded zone 18.

Mask Body

The mask body can be fashioned to have a curved, hemispherical shape as shown in FIG. 1 (see also U.S. Pat. No. 4,807,619 to Dyrud et al.), or it may take on other shapes as so desired. For example, the mask body can be a cup-shaped mask having a construction like the face mask disclosed in U.S. Pat. No. 4,827,924 to Japuntich. The mask also could have the three-fold configuration that can fold flat when not in use but can open into a cup-shaped configuration when worn—see U.S. Pat. Nos. 6,484,722B2 and 6,123,077 to Bostock et al., and U.S. Design Pat. No. Des. 431,647 to Henderson et al., and Des. 424,688 to Bryant et al. Face masks of the invention also may take on many other configurations, such as flat bifold masks disclosed in U.S. Design Pat. Nos. Des. 448,472S and Des. 443,927S to Chen.

Filtering Structure

The filtering structure removes contaminants from the ambient air and may also act as a barrier layer that precludes liquid splashes from entering the mask interior.

The partially occluded outer cover web acts to stop or slow any liquid splashes, and the inner filtering structure may then contain them if there is penetration past the outer cover web. The filtering structure can be of a particle capture or gas and vapor type filter. The filtering structure may include multiple layers of similar or dissimilar filter media and one or more cover webs as the application requires.

Filtration Layer

Filters that may be beneficially employed in a layered mask body of the invention are generally low in pressure drop (for example, less than about 195 to 295 Pascals at a face velocity of 13.8 centimeters per second) to minimize the breathing work of the mask wearer. Filtration layers additionally are flexible and have sufficient shear strength so that they generally retain their structure under the expected use conditions. Examples of particle capture filters include one or more webs of fine inorganic fibers (such as fiberglass) or polymeric synthetic fibers. Synthetic fiber webs may include electret-charged polymeric microfibers that are produced from processes such as meltblowing. Polyolefin microfibers formed from polypropylene that has been electrically charged provide particular utility for particulate capture applications.

The filtration layer is typically chosen to achieve a desired filtering effect. The filtration layer generally will remove a high percentage of particles and/or or other contaminants from the gaseous stream that passes through it. For fibrous filter layers, the fibers selected depend upon the kind of substance to be filtered and, typically, are chosen so that they do not become bonded together during the manufacturing operation. As indicated, the filtration layer may come in a variety of shapes and forms and typically has a thickness of about 0.2 millimeters (mm) to 1 centimeter (cm), more typically about 0.3 mm to 0.5 cm, and it could be a generally planar web or it could be corrugated to provide an expanded surface area—see, for example, U.S. Pat. Nos. 5,804,295 and 5,656,368 to Braun et al. The filtration layer also may include multiple filtration layers joined together by an adhesive or any other means. Essentially any suitable material that is known (or later developed) for forming a filtering layer may be used as the filtering material. Webs of melt-blown fibers, such as those taught in Wente, Van A., *Superfine Thermoplastic Fibers,* 48 Indus. Engn. Chem., 1342 et seq. (1956), especially when in a persistent electrically charged (electret) form are especially useful (see, for example, U.S. Pat. No. 4,215,682 to Kubik et al.). These melt-blown fibers may be microfibers that have an effective fiber diameter less than about 20 micrometers (μm) (referred to as BMF for "blown microfiber"), typically about 1 to 12 p.m. Effective fiber diameter may be determined according to Davies, C. N., *The Separation Of Airborne Dust Particles*, Institution Of Mechanical Engineers, London, Proceedings 1B, 1952. Particularly preferred are BMF webs that contain fibers formed from polypropylene, poly(4-methyl-1-pentene), and combinations thereof. Electrically charged fibrillated-film fibers as taught in van Turnhout, U.S. Pat. No. Re. 31,285, also may be suitable, as well as rosin-wool fibrous webs and webs of glass fibers or solution-blown, or electrostatically sprayed fibers, especially in microfiber form. Electric charge can be imparted to the fibers by contacting the fibers with water as disclosed in U.S. Pat. No. 6,824,718 to Eitzman et al., U.S. Pat. No. 6,783,574 to Angadjivand et al., U.S. Pat. No. 6,743,464 to Insley et al., U.S. Pat. Nos. 6,454,986 and 6,406,657 to Eitzman et al., and U.S. Pat. Nos. 6,375,886 and 5,496,507 to Angadjivand et al. Electric charge also may be imparted to the fibers by corona charging as disclosed in U.S. Pat. No. 4,588,537 to Klasse et al. or by tribocharging as disclosed in U.S. Pat. No. 4,798,850 to Brown. Also, additives can be included in the fibers to enhance the filtration performance of webs produced through the hydro-charging process (see U.S. Pat. No. 5,908,598 to Rousseau et al.). Fluorine atoms, in particular, can be disposed at the surface of the fibers in the filter layer to improve filtration performance in an oily mist environment—see U.S. Pat. Nos. 6,398,847 B1, 6,397,458 B1, and 6,409,806 B1 to Jones et al. Typical basis weights for electret BMF filtration layers are about 10 to 100 grams per square meter ($g/m^2$). When electrically charged according to techniques described in, for example, the '507 Angadjivand et al. patent, and when including fluorine atoms as mentioned in the Jones et al. patents, the basis weight may be about 20 to 40 $g/m^2$ and about 10 to 30 $g/m^2$, respectively.

Cover Web(s)

The cover webs also may have filtering abilities, although typically not nearly as good as the filtering layer and/or may serve to make the mask more comfortable to wear. The cover webs may be made from nonwoven fibrous materials such as spun bonded fibers that contain, for example, polyolefins, and polyesters—see, for example, U.S. Pat. No. 6,041,782 to Angadjivand et al., U.S. Pat. No. 4,807,619 to Dyrud et al., and U.S. Pat. No. 4,536,440 to Berg. When a wearer inhales, air is drawn through the mask body, and airborne particles become trapped in the interstices between the fibers, particularly the fibers in the filter layer.

The inner cover web can be used to provide a smooth surface for contacting the wearer's face, and the outer cover web, in addition to providing splash fluid protection, can be used for entrapping loose fibers in the mask body and for aesthetic reasons. The cover web typically does not provide any substantial filtering benefits to the filtering structure, although it can act as a pre-filter when disposed on the exterior of (or upstream to) the filtration layer. To obtain a suitable degree of comfort, an inner cover web preferably has a comparatively low basis weight and is formed from comparatively fine fibers. More particularly, the cover web may be fashioned to have a basis weight of about 5 to 50 g/m$^2$ (typically 10 to 30 g/m$^2$), and the fibers may be less than 3.5 denier (typically less than 2 denier, and more typically less than 1 denier but greater than 0.1 denier). Fibers used in the cover web often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Suitable materials for the cover web may be blown microfiber (BMF) materials, particularly polyolefin BMF materials, for example polypropylene BMF materials (including polypropylene blends and also blends of polypropylene and polyethylene). A suitable process for producing BMF materials for a cover web is described in U.S. Pat. No. 4,013,816 to Sabee et al. The web may be formed by collecting the fibers on a smooth surface, typically a smooth-surfaced drum or a rotating collector—see U.S. Pat. No. 6,492,286 to Berrigan et al. Spun-bond fibers also may be used.

A typical cover web may be made from polypropylene or a polypropylene/polyolefin blend that contains 50 weight percent or more polypropylene. These materials have been found to offer high degrees of softness and comfort to the wearer and also, when the filter material is a polypropylene BMF material, to remain secured to the filter material without requiring an adhesive between the layers. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. One example of a fiber for the cover web is a polypropylene BMF made from the polypropylene resin "Escorene 3505G" from Exxon Corporation, providing a basis weight of about 25 g/m$^2$ and having a fiber denier in the range 0.2 to 3.1 (with an average, measured over 100 fibers of about 0.8). Another suitable fiber is a polypropylene/polyethylene BMF (produced from a mixture comprising 85 percent of the resin "Escorene 3505G" and 15 percent of the ethylene/alpha-olefin copolymer "Exact 4023" also from Exxon Corporation) providing a basis weight of about 25 g/m$^2$ and having an average fiber denier of about 0.8. Suitable spunbond materials are available, under the trade designations "Corosoft Plus 20", "Corosoft Classic 20" and "Corovin PP-S-14", from Corovin GmbH of Peine, Germany, and a carded polypropylene/viscose material available, under the trade designation "370/15", from J. W. Suominen OY of Nakila, Finland.

Cover webs that are used in the invention preferably have very few fibers protruding from the web surface after processing and therefore have a smooth outer surface. Examples of cover webs that may be used in the present invention are disclosed, for example, in U.S. Pat. No. 6,041,782 to Angadjivand, U.S. Pat. No. 6,123,077 to Bostock et al., and WO 96/28216A to Bostock et al.

Shaping Layer

The shaping layer(s) may be formed from at least one layer of fibrous material that can be molded to the desired shape with the use of heat and that retains its shape when cooled. Shape retention is typically achieved by causing the fibers to bond to each other at points of contact between them, for example, by fusion or welding. Any suitable material known for making a shape-retaining layer of a direct-molded respiratory mask may be used to form the mask shell, including, for example, a mixture of synthetic staple fiber, preferably crimped, and bicomponent staple fiber. Bicomponent fiber is a fiber that includes two or more distinct regions of fibrous material, typically distinct regions of polymeric materials. Typical bicomponent fibers include a binder component and a structural component. The binder component allows the fibers of the shape-retaining shell to be bonded together at fiber intersection points when heated and cooled. During heating, the binder component flows into contact with adjacent fibers. The shape-retaining layer can be prepared from fiber mixtures that include staple fiber and bicomponent fiber in a weight-percent ratios that may range, for example, from 0/100 to 75/25. Preferably, the material includes at least 50 weight-percent bicomponent fiber to create a greater number of intersection bonding points, which, in turn, increase the resilience and shape retention of the shell.

Suitable bicomponent fibers that may be used in the shaping layer include, for example, side-by-side configurations, concentric sheath-core configurations, and elliptical sheath-core configurations. One suitable bicomponent fiber is the polyester bicomponent fiber available, under the trade designation "KOSA T254" (12 denier, length 38 mm), from Kosa of Charlotte, N.C., U.S.A., which may be used in combination with a polyester staple fiber, for example, that available from Kosa under the trade designation "T259" (3 denier, length 38 mm) and possibly also a polyethylene terephthalate (PET) fiber, for example, that available from Kosa under the trade designation "T295" (15 denier, length 32 mm). Alternatively, the bicomponent fiber may comprise a generally concentric sheath-core configuration having a core of crystalline PET surrounded by a sheath of a polymer formed from isophthalate and terephthalate ester monomers. The latter polymer is heat softenable at a temperature lower than the core material. Polyester has advantages in that it can contribute to mask resiliency and can absorb less moisture than other fibers.

Alternatively, the shaping layer can be prepared without bicomponent fibers. For example, fibers of a heat-flowable polyester can be included together with staple, preferably crimped, fibers in a shaping layer so that, upon heating of the web material, the binder fibers can melt and flow to a fiber intersection point where it forms a mass, that upon cooling of the binder material, creates a bond at the intersection point. A mesh or net of polymeric strands could also be used in lieu of thermally bondable fibers. An example of this type of a structure is described in U.S. Pat. No. 4,850,347 to Skov.

When a fibrous web is used as the material for the shape-retaining shell, the web can be conveniently prepared on a "Rando Webber" air-laying machine (available from Rando Machine Corporation, Macedon, N.Y.) or a carding machine. The web can be formed from bicomponent fibers or other fibers in conventional staple lengths suitable for such equipment. To obtain a shape-retaining layer that has the required resiliency and shape-retention, the layer preferably has a basis weight of at least about 100 g/m$^2$, although lower basis weights are possible. Higher basis weights, for example, approximately 150 or more than 200 g/m$^2$, may provide greater resistance to deformation and greater resiliency and may be more suitable if the mask body is used to support an exhalation valve. Together with these minimum basis weights, the shaping layer typically has a maximum density of about 0.2 g/cm$^2$ over the central area of the mask. Typically, the shaping layer would have a thickness of about 0.3 to 2.0, more typically about 0.4 to 0.8 millimeters. Examples of shaping layers suitable for use in the present invention are described in the following patents: U.S. Pat. No. 5,307,796 to Kronzer et al., U.S. Pat. No. 4,807,619 to Dyrud et al., and U.S. Pat. No. 4,536,440 to Berg.

The straps may be secured to the mask body using adhesives, welding, and fasteners such as staples—see U.S. Pat. No. 6,705,317 to Castiglione. Examples of mask harnesses that may be used in connection with the present invention are shown in U.S. Pat. Nos. 6,457,473B1, 6,062,221, and 5,394,568, and to Brostrom et al., U.S. Pat. No. 6,332,465B1 to Xue et al., U.S. Pat. Nos. 6,119,692 and 5,464,010 to Byram, and U.S. Pat. Nos. 6,095,143 and 5,819,731 to Dyrud et al.

Respirator Components

As indicated, an exhalation valve may be attached to the mask body to facilitate purging exhaled air from the interior gas space. The use of an exhalation valve may improve wearer comfort by rapidly removing the warm moist exhaled air from the mask interior. See, for example, U.S. Pat. Nos. 7,188,622, 7,028,689, and 7,013,895 to Martin et al.; U.S. Pat. Nos. 7,428,903, 7,311,104, 7,117,868, 6,854,463, 6,843,248, and 5,325,892 to Japuntich et al.; U.S. Pat. No. 6,883,518 to Mittelstadt et al.; and RE37,974 to Bowers. Essentially any exhalation valve that provides a suitable pressure drop and that can be properly secured to the mask body may be used in connection with the present invention to rapidly deliver exhaled air from the interior gas space to the exterior gas space. A nose clip also may be attached to the mask body to improve wearer fit over the nose and beneath the eyes. The nose clip may comprise a pliable dead soft band of metal such as aluminum can to allow it to be shaped to hold the face mask in a desired fitting relationship over the nose of the wearer and where the nose meets the cheek. An example of a suitable nose clip is shown in U.S. Pat. Nos. 5,558,089 and Des. 412,573 to Castiglione.

The strap(s) that are used in the harness may be made from a variety of materials, such as thermoset rubbers, thermoplastic elastomers, braided or knitted yarn/rubber combinations, inelastic braided components, and the like. The strap(s) may be made from an elastic material such as an elastic braided material. The strap preferably can be expanded to greater than twice its total length and be returned to its relaxed state. The strap also could possibly be increased to three or four times its relaxed state length and can be returned to its original condition without any damage thereto when the tensile forces are removed. The elastic limit thus is preferably not less than two, three, or four times the length of the strap when in its relaxed state. Typically, the strap(s) are about 20 to 30 cm long, 3 to 10 mm wide, and about 0.9 to 1.5 mm thick. The strap(s) may extend from the first tab to the second tab as a continuous strap or the strap may have a plurality of parts, which can be joined together by further fasteners or buckles. For example, the strap may have first and second parts that are joined together by a fastener that can be quickly uncoupled by the wearer when removing the mask body from the face. An example of a strap that may be used in connection with the present invention is shown in U.S. Pat. No. 6,332,465 to Xue et al. Examples of fastening or clasping mechanism that may be used to joint one or more parts of the strap together is shown, for example, in the following U.S. Pat. No. 6,062,221 to Brostrom et al., U.S. Pat. No. 5,237,986 to Seppala, and EP1,495,785A1 to Chien.

Examples

Spacer Element Preparation

Polymer spacer elements were made as follows. A nonwoven substrate was fed into casting roll. Formable polypropylene homopolymer Total 3868 (Total Petrochemical Co., PO Box 674411, Houston Tex. 77267) was conveyed and extruded from 18 inch wide hung die and a 2.5 inch single screw extruder. The polymer was conveyed under compression and pineapple mixer extruder was used which was made by Davis Standard (1 Extrusion Drive, Pawcatuck, Conn. 06379). Molten polymer was deposited on casting roll using a microreplication tool to transfer post/stems onto the substrate. The web was cooled down using chilled rolls and was wound up into a roll format. Spacer element configurations were as follows:

TABLE 1

| Example | Filtering Structure Basis Weight (gsm) | Substrate | Spacer Element diameter (mm) | Spacer Element Height (mm) | Mask Body Thickness (mm) | Occlusion Zone Thickness (mm) | Non-occluded Zone Thickness (mm) |
|---|---|---|---|---|---|---|---|
| 1 | 107 | A | 1.0 | 1.7 | 3.89 | 1.9 | 0.19 |
| 2 | 107 | B | 0.6 | 2.1 | 4.29 | 2.3 | 0.15 |
| 3 | 107 | C | 0.8 | 2.0 | 4.09 | 2.1 | 0.11 |

Material Used:

| Material | Description |
|---|---|
| Substrate A | Polypropylene spundbond Nonwoven White 1.0 osy/ 34 gram/m$^2$, available from Atex Inc. Gainville, GA |
| Substrate B | Polypropylene spundbond nonwoven white 0.75 osy/ 25.5 gram/m$^2$, available from ShanDong Kangjie nonwoven Co LTD, Jinan China |
| Substrate C | Polypropylene spundbond nonwoven white 0.5 osy/ 17 gram/m$^2$, available from ShanDong Kangjie nonwoven Co LTD, Jinan China |

Mask Body Assembly:

The spacer element/outer cover web layer was joined to the filtering structure that comprised a shaping layer and a filter layer to provide an assembly as shown in FIG. 2. The spacer element columns were oriented to face the filtration media layer. These layers were welded and trimmed using a Branson Ultrasonic Welder (Branson Ultrasonics, Danbury, Conn.), model 2000ae and sine wave anvil.

Test Methods:

Respirators were tested according to ASTM-1862-07 Standard Test Method for Resistance of Medical Face Masks to Penetration by Synthetic Blood (Horizontal Projection of Fixed Volume at a Known Velocity) protocol. Pressure drop was measured according to NIOSH 42 CFR standards at 85 liters per minute, 2% sale for an instantaneous pressure drop. The results are set forth in Table 2 below.

Comparative Examples

These were control samples prepared using similar materials but without the spacer elements and occluded and non-occluded areas like the present invention.

TABLE 2

| Example | Substrate (Nonwoven Basis weight (osy)) | Highest level of Fluid Resistance Challenge Level According to ASTM1862-07 | Splash Test/Fluid Resistance Pass or Fail | Pressure Drop ($mmH_2O$) |
|---|---|---|---|---|
| 1 | A (1.0) | 0/32 | Pass | 8.5 |
| 2 | B (0.75) | 0/32 | Pass | 7.9 |
| 3 | C (0.5) | 0/32 | Pass | 6.8 |
| C1 | A (1.0) | 18/32 | Fail | 9.0 |
| C2 | B (0.75) | 24/32 | Fail | 9.1 |
| C3 | C (0.5) | 27/32 | Fail | 8.5 |

Basis weight is given in ounces per yard, and the number of units passed/failed is given per 32 respirators tested.

The data show improved fluid resistance at the highest level using a spaced occluded web according to the present invention. Of the 32 samples tested, none of the inventive samples failed. Further, pressure drop across the mask body generally was lower in prototypes of the present invention.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A filtering face-piece respirator that comprises:

(a) a mask body that includes:

(i) a filter layer; and (ii) a nonwoven fibrous cover web that has partial occlusions and that is generally parallel to and is spaced from the filter layer such that air passing through the cover web can move freely between the cover web and the filter layer so that the air can enter the filter layer at essentially any available point over the filter layer surface; and (b) a harness that is joined to the mask body.

2. The filtering face-piece respirator of claim 1, wherein the partial occlusions are in the form of stripes that extend across the outer surface of the cover web.

3. The filtering face-piece respirator of claim 1, wherein the cover web is an outer cover web that includes occluded and non-occluded areas.

4. The filtering face-piece respirator of claim 3, wherein the occluded areas comprise a fluid impermeable plastic material.

5. The filtering face-piece respirator of claim 4, wherein the occluded areas comprise stripes that extend from a first side of the mask body to a second side.

6. The filtering face-piece respirator of claim 1, wherein the partial occlusions include occluded and non-occluded areas on an outer cover web, and wherein each occluded area is spaced not more than 1.75 millimeters from an adjacent non-occluded area.

7. The filtering face-piece respirator of claim 1, wherein the nonwoven fibrous cover web is an outer cover web that has occluded and non-occluded areas, and wherein the occluded areas typically are present on the mask body at a surface area ratio maximum of about 4.4:1.4 and at a minimum of about 2.6:3.8 to the non-occluded areas of the mask body.

8. The filtering face-piece respirator of claim 1, wherein the mask body comprises spacer elements that separate the nonwoven fibrous cover web from the filter layer.

9. The filtering face-piece respirator of claim 8, wherein the spacer elements have a length of about 0.5 to 3 mm.

10. The filtering face-piece respirator of claim 9, wherein the spacer elements have a length of about 1 to 2.5 mm.

11. The filtering face-piece respirator of claim 10, wherein the spacer elements have a cross-sectional area of about 0.1 to 1 $mm^2$.

12. The filtering face-piece respirator of claim 11, wherein the spacer elements have a cross-sectional area of about 0.15 to 0.25 $mm^2$.

13. The filtering face-piece respirator of claim 8, wherein there are about 5 to 30 spacer elements per centimeter along a length of the occluded area.

14. The filtering face-piece respirator of claim 8, wherein the spacer elements have ends that are bonded or entangled in the filter layer.

15. The filtering face-piece respirator of claim 8, wherein the spacer elements create a reservoir space that reduces kinetic energies of impacting fluids.

16. The filtering face-piece respirator of claim 8, wherein the spacer elements facilitate airflow between the nonwoven fibrous cover web and the filter layer to help distribute the air across the filter layer's surface.

17. The filtering face-piece respirator of claim 8, wherein the spacer elements are made by microreplication.

18. The filtering face-piece respirator of claim 1, wherein the mask body exhibits a pressure drop that is less than the pressure drop across the same mask body without the partial occlusions.

19. The filtering face-piece respirator of claim 3, wherein the mask body exhibits a pressure drop that is the same or less than a pressure drop across the same mask body without the occluded areas.

20. The filtering face-piece respirator of claim 3, wherein the mask body exhibits a pressure drop that is 10% less than a pressure drop across a similar mask body that does not include occluded areas.

21. The filtering face-piece respirator of claim 3, wherein there are two or more spacer elements extending across a width of an elongated occluded area.

22. The filtering face-piece respirator of claim 4, wherein the partial occlusions are integral to spacer elements that separate the nonwoven fibrous cover web from the filter layer.

23. The filtering face-piece respirator of claim 1, wherein the partial occlusions are integral to spacer elements that separate the nonwoven fibrous cover web from the filter layer.

24. The filtering face-piece respirator of claim 23, wherein the spacer elements extend from the cover web to the filter layer.

* * * * *